US006006937A

United States Patent [19]

Baravaglio et al.

[11] Patent Number: 6,006,937

[45] Date of Patent: Dec. 28, 1999

[54] CONTAINER HAVING A BODY, CAP, AND INTERMEDIARY PART

[75] Inventors: Christian Baravaglio, Sevrier; René Point, Oyonnax, both of France

[73] Assignee: Compagnie Europeenne Industrielle et Commerciale d'Application, Brion, France

[21] Appl. No.: 08/860,645

[22] PCT Filed: Dec. 6, 1995

[86] PCT No.: PCT/FR95/01611

§ 371 Date: Jun. 24, 1997

§ 102(e) Date: Jun. 24, 1997

[87] PCT Pub. No.: WO96/18553

PCT Pub. Date: Jun. 20, 1996

[30] Foreign Application Priority Data

Dec. 15, 1994 [FR] France ..... 94/15293

[51] Int. Cl.[6] ..... B65D 1/10

[52] U.S. Cl. ..... 220/62.18; 206/823

[58] Field of Search ..... 220/254, 258, 220/23.83, 23.86, 23.87, 23.9, 691, 921, 919, 918, 4.01, 4.04, 4.08, 4.28, 575, 574, 592.26, 592.27, 506, 525, 526, 529, 62.18, 62.22, 62.11, 654; 206/581, 823

[56] References Cited

U.S. PATENT DOCUMENTS

| | | | |
|---|---|---|---|
| 2,012,942 | 9/1935 | Acker | 206/823 |
| 2,057,293 | 10/1936 | Dreux et al. | 206/823 |
| 2,575,283 | 11/1951 | Menrath | 220/23.87 |
| 4,240,560 | 12/1980 | Carluccio | 215/12 R |
| 4,915,255 | 4/1990 | Curtis | 220/23.86 |
| 4,969,573 | 11/1990 | Dupuis et al. | 220/259 |
| 5,052,568 | 10/1991 | Simon | 220/254 |
| 5,207,345 | 5/1993 | Stewart et al. | 220/254 |
| 5,356,025 | 10/1994 | Renault | 220/263 |
| 5,542,562 | 8/1996 | Oratz | 220/23.86 |
| 5,896,866 | 4/1999 | Quennessen | 132/293 |

FOREIGN PATENT DOCUMENTS

| | | |
|---|---|---|
| 0367646 | 5/1990 | European Pat. Off. . |
| 0390646 | 10/1990 | European Pat. Off. . |
| 2540834 | 8/1984 | France . |
| 2669307 | 5/1992 | France . |
| 2939664 | 4/1981 | Germany . |

*Primary Examiner*—Stephen Castellano
*Attorney, Agent, or Firm*—Greenblum & Bernstein, P.L.C.

[57] ABSTRACT

A container, including a jar closed by a cap, the jar being of the type that includes a container body formed by a first peripheral wall, forming a housing intended to receive the contents of the container. An intermediary part is adapted to be affixed to the container body, the intermediary part including a sealing cover. A cap is secured on the intermediary part. The external wall of the jar is totally or partially formed by a second peripheral wall of the container body. The container is assembled, after filling, by fitting the intermediary part to the container body, with the sealing cover having been fixed in place.

21 Claims, 14 Drawing Sheets

FIG 1
Fig 1a
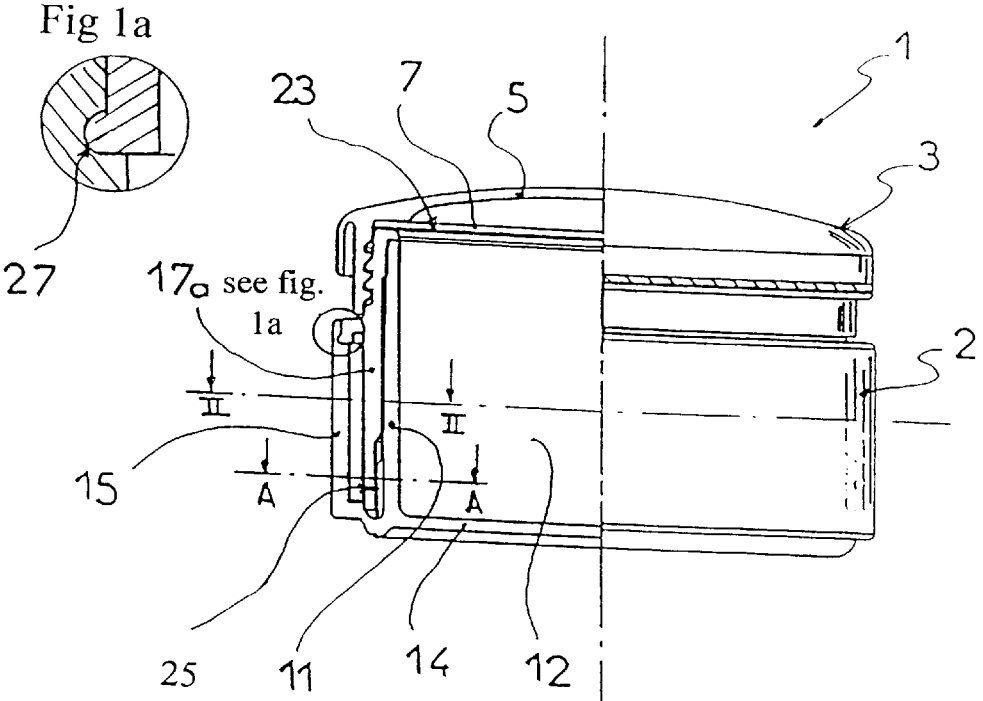
FIG 2
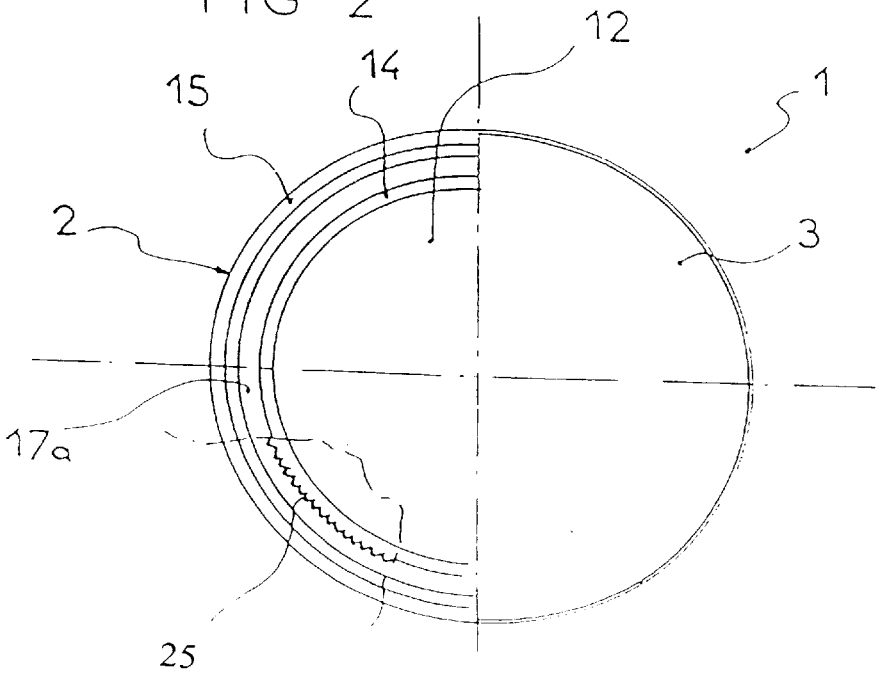

CONTAINER HAVING A BODY, CAP, AND INTERMEDIARY PART

BACKGROUND OF THE INVENTION

1. Field of the Invention

The present invention relates to an improvement to a container, such as a pot or jar or the like. It relates more particularly, but not specifically, to containers for cosmetics and perfume.

2. Description of Background and Relevant Information

Nowadays, one knows the importance of the containers used in perfumery, and especially those sold for skin care creams, such as liposome-base creams, for example. For the consumer, these containers must have an appealing, distinctive appearance, while meeting the basic hygiene or quality requirements.

Known containers commercially available these days are constituted by glass or plastic jars closed by a lid or cap that is generally screwed on the jar body of the jar. But although the current containers are aesthetically appealing, such is not the case with respect to the hygiene of the product in the container, which must kept as impervious as possible. Of course, the manufacturers preferably use caps that are screwed on and which most often include a flexible sealing gasket inserted between the cap and the opening edge of the pot, in order to enable proper closure; but this type of arrangement, in spite of its appearance, is not totally satisfactory. That is why perfumers have thought of providing a cover for the jar filled with cream in order to obtain a perfect sealing before the product is used. But in this case, the cover positioning must be performed by the perfumer after the jar is filled, and before the cap is positioned. This is a supplemental, and therefore costly step for the perfumer. In addition, the positioning of the cover, while the container is already filled with cream, can create dirt and produce bacteria that are prejudicial to the hygiene of the product.

Jars have already been proposed to solve the cover-related problem, such as that disclosed in the French Application No. 83 02469, published as No. 2 540 834, for example, according to which the cover is placed on an independent supplemental part added to a conventional jar.

SUMMARY OF THE INVENTION

A object of the present invention is to overcome the aforementioned disadvantages by proposing a new design for a container, which has a number of advantages, both for the manufacturer thereof and the perfumer who must fill it. The container of the invention is equipped with a clean cover which is not handled by the perfumer, since it is integral with an additional part to be positioned after the filling.

Thus, the container of the invention is a jar closed by a cap, of the type whose opening is temporarily blocked by a cover, wherein the jar is constituted by a container body to which an intermediary part including the cover is affixed, the cap cooperating with the intermediary part for the closure of the jar.

Thus, the container of the invention is a jar closed by a cap, said jar being of the type constituted by a container body formed by a first peripheral wall forming the housing which is intended to receive the content, and to which an intermediary part including the cover is affixed, the cap cooperating with the intermediary part, wherein the external wall of the jar can be totally or partially constituted by a second peripheral wall of the container body and/or by a peripheral wall of the intermediary part.

According to complementary characteristics, the container body includes a second peripheral wall spaced from the first peripheral wall, to thereby create a peripheral space between the two walls. In a preferred solution, the second peripheral wall is connected to the lower transverse wall constituting the base of the jar to extend upwardly.

According to another complementary characteristic, the container body is formed by a first peripheral wall forming the housing which is intended to receive the content, such as cosmetic cream, for example, the housing being opened upwardly and closed downwardly by a lower transverse wall constituting the base of the jar.

In addition, the intermediary part has the general shape of a ring and is constituted by a cylindrical intermediary peripheral wall forming a cylindrical central housing, the upper portion of the external surface of the wall including an external threading adapted to cooperate with the internal threading of the cap, while the intermediary part includes a removable cover affixed to the upper edge of the peripheral wall, and the intermediary peripheral wall of the intermediary part is extended downwardly by a peripheral wall extending downwardly.

Latching means are provided which ensure the rotational and translational blocking of the intermediary part with respect to the container body.

According to a first embodiment, the external wall of the jar is constituted, at least partially, by the peripheral wall of the container body, and partially by the peripheral wall of the intermediary part, whereas according to two alternative embodiments, the external wall of the jar is constituted, either totally by the second peripheral wall of the container body, or totally by the peripheral wall of the intermediary part.

BRIEF DESCRIPTION OF THE DRAWINGS

Other characteristics and advantages of the invention will become apparent from the following description, with reference to the annexed drawings which are only provided by way of non-limiting examples.

FIGS. 1–12 illustrate a first embodiment of a container according to the invention.

FIG. 1 is a lateral view with a radial half-section.

FIG. 1*a* is an enlarged view of a detail of FIG. 1.

FIG. 2 is a top view with a half-section along II—II and a partial section along A—A.

FIG. 3 is a lateral exploded view with a half-section showing the various constituent elements of the container.

FIG. 4 is a perspective exploded view showing, as does FIG. 3, all the constituent elements of the container.

FIG. 5 is a view similar to FIG. 3, showing the elements of the container in an intermediary position with positioning of the gasket in the cap and of the cover on the intermediary part.

FIG. 6 is a view similar to FIG. 5 but in a perspective representation.

FIG. 7 is a lateral view with a half-section showing the container with its subassemblies, as it can be delivered to the laboratory for the filling.

FIG. 8 is a view similar to FIG. 7 but in a perspective representation.

FIGS. 9, 10, 11, and 12 illustrate in perspective the utilization of the container of the invention.

FIGS. 13 and 14 illustrates a variation of the invention, FIG. 13 being a view similar to FIG. 1, while FIG. 14 shows the complementary part serving as a ballast.

FIG. 15*a* is an enlarged view of a detail of FIG. 15.

Figure 3:
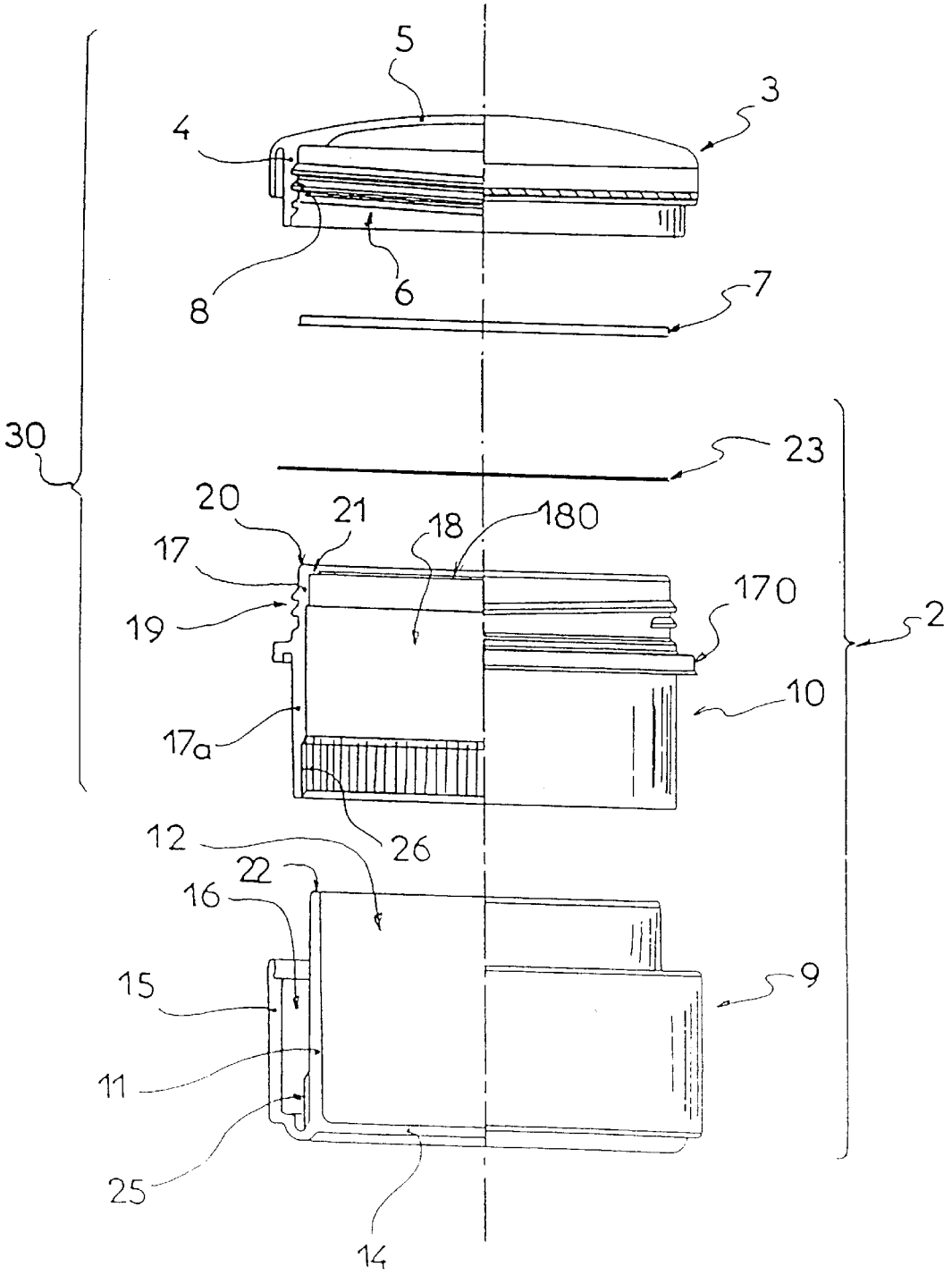
Figure 4:
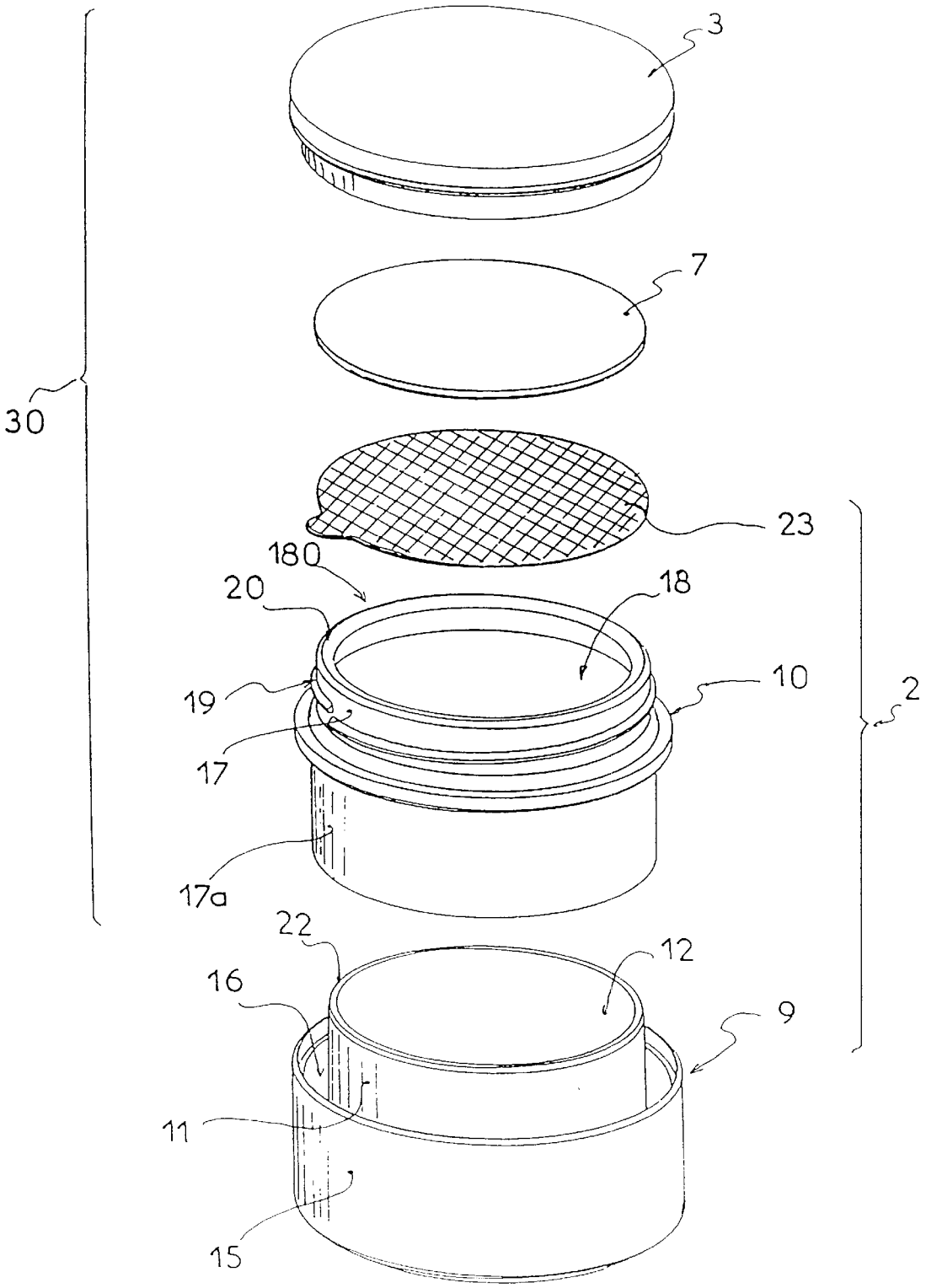

It is noted that most of these drawings have been voluntarily provided without hatching, so that they can be more legible. Furthermore, similar elements in the various embodiments have the same reference numerals. It is also noted that for anything that is not expressly described, the reader should refer to the drawings.

DETAILED DESCRIPTION OF THE INVENTION

FIGS. 1–12 illustrate a first embodiment of a container according to the invention which bears the generic reference (1). The container is constituted by a jar (2) and by a cap (3) which advantageously is of the screw-threaded type, the closure of the pot (1) being carried out by screwing the cap (3), as is well known in itself.

The cap (3) is therefore constituted by a peripheral wall (4) of the cap and by a transverse upper wall (5) to constitute a cap cavity (6), open downwardly and whose bottom includes a sealing gasket (7) in the position for use, the necessary internal threading (8) being obtained on the internal surface of the peripheral wall (4).

The jar (2) is constituted, according to the invention, by the assembly of a container body (9) with an intermediary part (10) the function of which will be explained in more detail hereinafter.

The container body (9) constitutes the container itself and is formed by a first inner cylindrical peripheral wall (11) forming the housing (12) adapted to receive the content, such as cosmetic cream (13), for example. The housing (12) is open upwardly and closed downwardly by a lower transverse wall (14) constituting the base of the jar. Furthermore, the container body (9) includes a second, outer peripheral wall (15) connected to the lower transverse wall (14) to extend upwardly while being spaced from the first peripheral wall (11) and to thereby create a peripheral space (16) open upwardly.

The intermediary part (10) has the general shape of a ring and is constituted by an intermediary cylindrical peripheral wall (17) forming a central cylindrical housing (18). The upper portion of the external surface of the wall (17) includes an external threading (19), while the upper edge (20) edging the opening (180) is extended inwardly by a peripheral projection (21) which, as will be further described below, is adapted to take support on the upper edge (22) of the first peripheral wall of the container body. In addition, the external threading (19) of the intermediary part (10) is adapted to cooperate with the internal threading (8) of the cap (3).

Furthermore, the peripheral wall (17) of the intermediary part (10) is extended downwardly by a wall extension (17*a*), and includes an annular lateral projection (17) serving as an abutment and latching.

Figure 5:
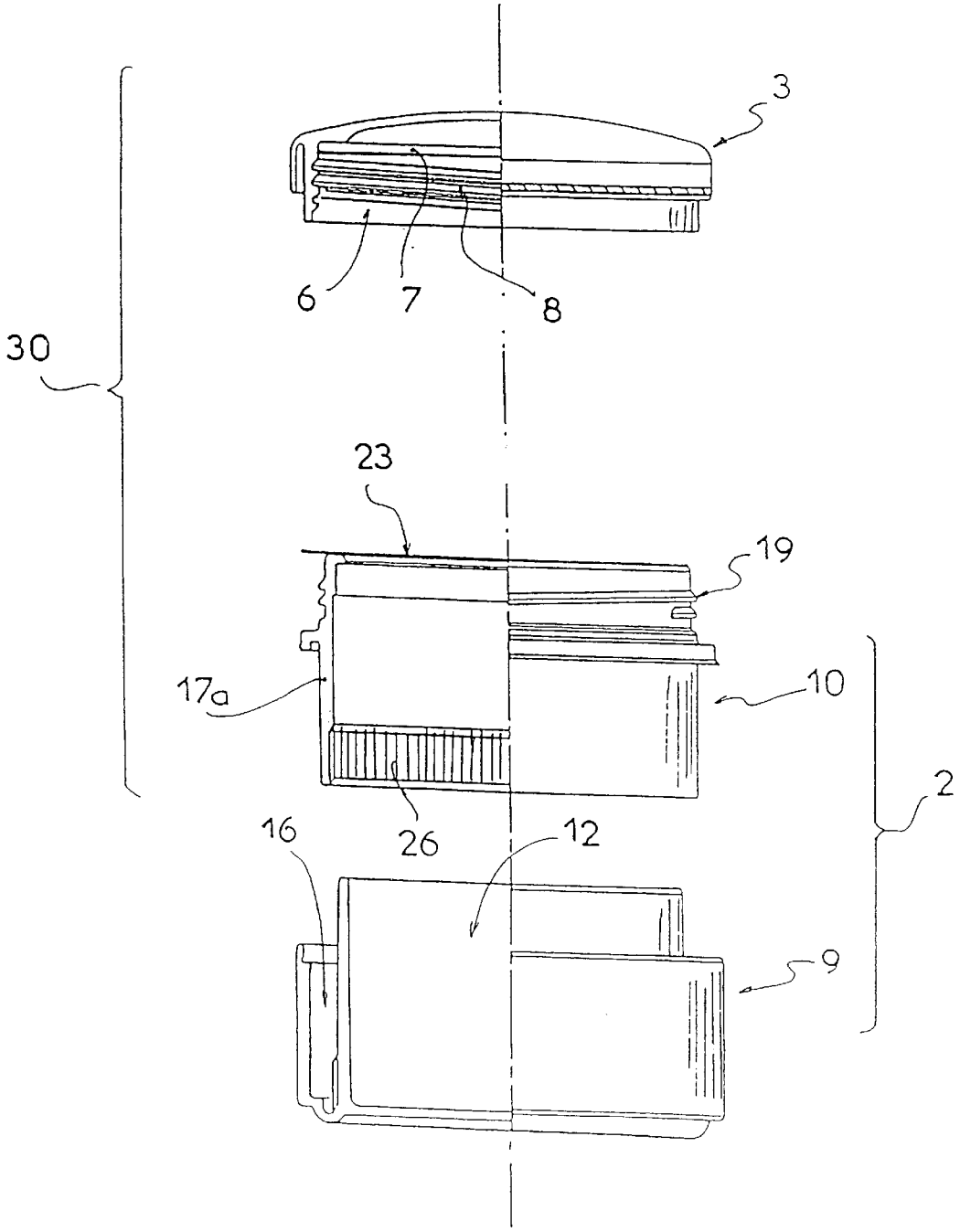
Figure 6:
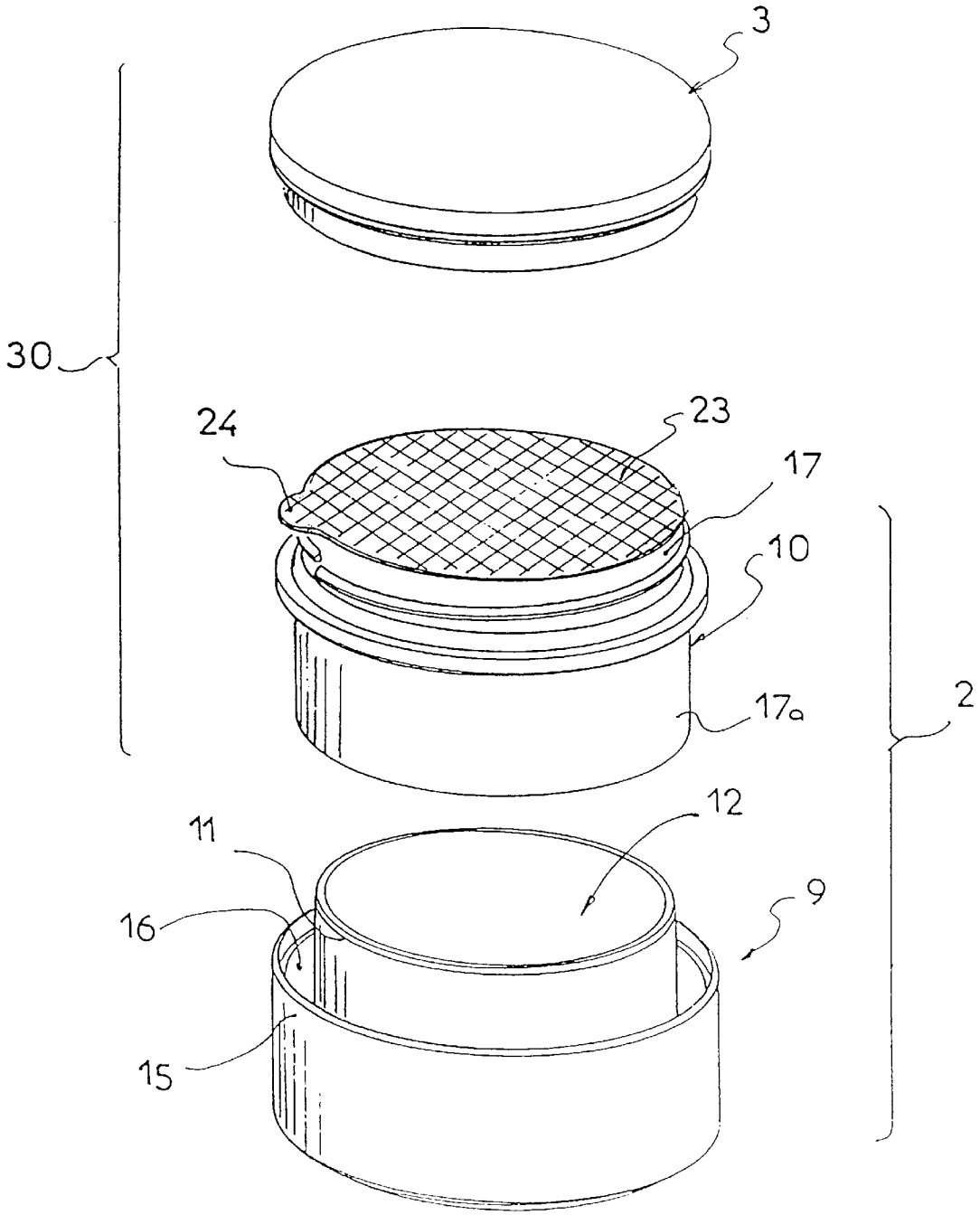

A clean and sealing cover (23) is provided which is affixed to the upper edge (20) of the intermediary part (10). This cover is cylindrical and is constituted, for example, by a thin aluminum disk which advantageously includes a gripping tab (24). The cover is attached on the intermediary part by welding or adhesion, according to known methods, such as conduction or ultrasonic or induction welding. In addition, the positioning of the cover (23) on the intermediary part (10), FIG. 5, is done before the positioning of the latter on the container body (9).

In the assembled position of the jar (2), the intermediary part (10) provided with the cover (23) is affixed on the container body. To this end, the wall extension (17*a*) of the intermediary part is engaged in the peripheral space (16) of the body, i.e., between the first wall (11) and the second wall (15). In this position, the intermediary part (10) is attached to the container body (9) to be affixed thereto. Furthermore, the intermediary part (10) is blocked in rotation and translation with respect to the body, due to rotational (28) and translational (27) latching means.

The rotational latching means are, for example, constituted by the cooperation of a series of teeth (25) obtained on the external surface of the first peripheral wall (11) of the container body (9) with a series of hollow sections (26) obtained on the internal surface of the wall extension (17*a*) of the intermediary part.

The translational latching means ensure the final blocking of the intermediary part (10) on the container body (9) and are obtained, for example, by a ratchet type device (27).

In addition, the container body (9), the intermediary part (10) and the cap are obtained, for example, by injection of a plastic material such as polyethylene, polypropylene, or the like. Of course, the container body (9), the intermediary part (10) and the cap (3) can be made of a same material. But it can be otherwise, and each of the part can be made of different materials, as needed, and depending in particular on costs, on compatibility problems between the cream and the container wall, or on purely aesthetic requirements.

It is understood that under these conditions, the concept according to the invention is particularly interesting because, due to the mounting of the jar (2) by assembly of two parts, i.e., the container body (9) and the intermediary part (10), it is possible to design parts in which the wall thickness is constant, while allowing as varied external aspects of the container assembly as possible.

Figure 7:
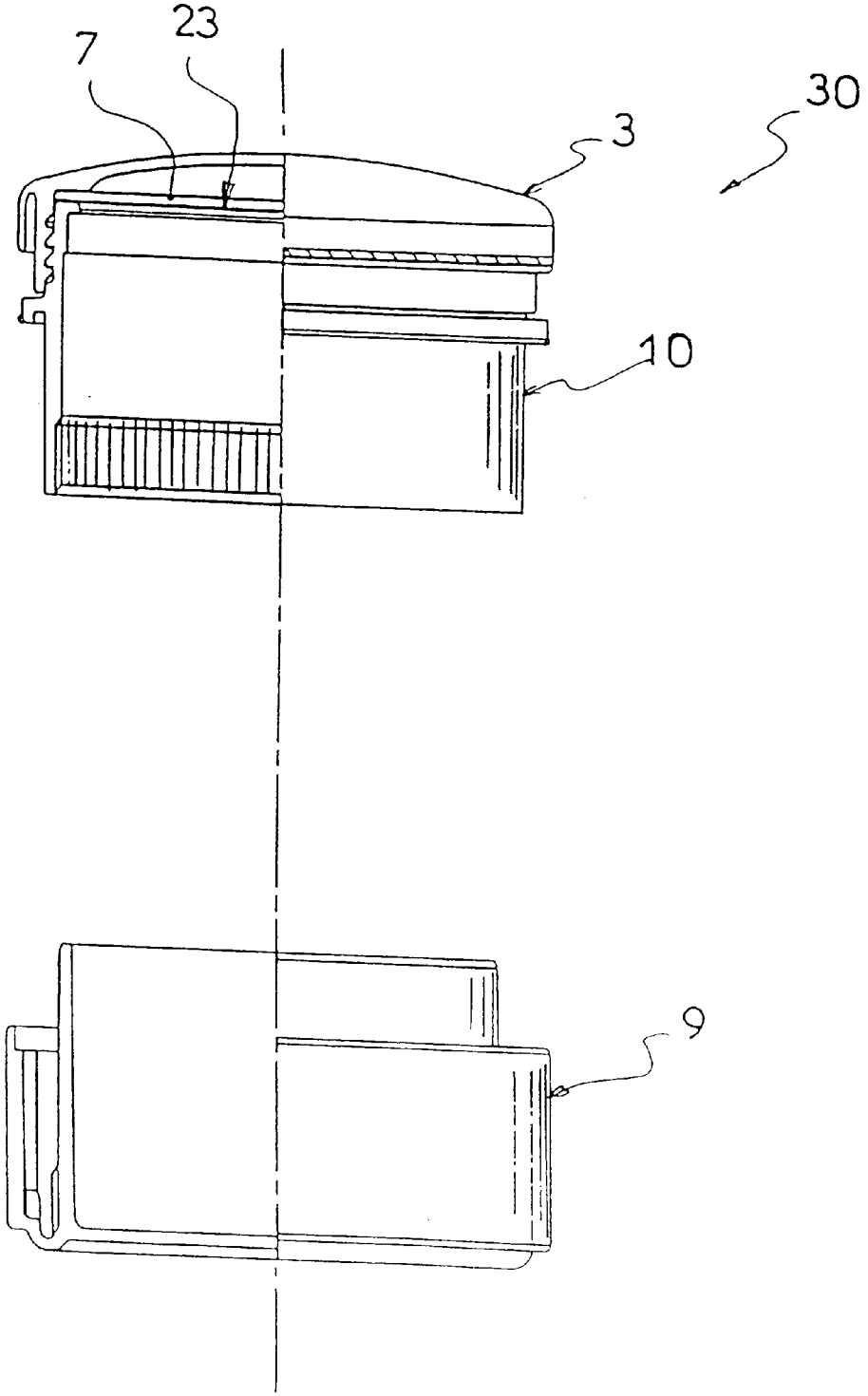
Figure 8:
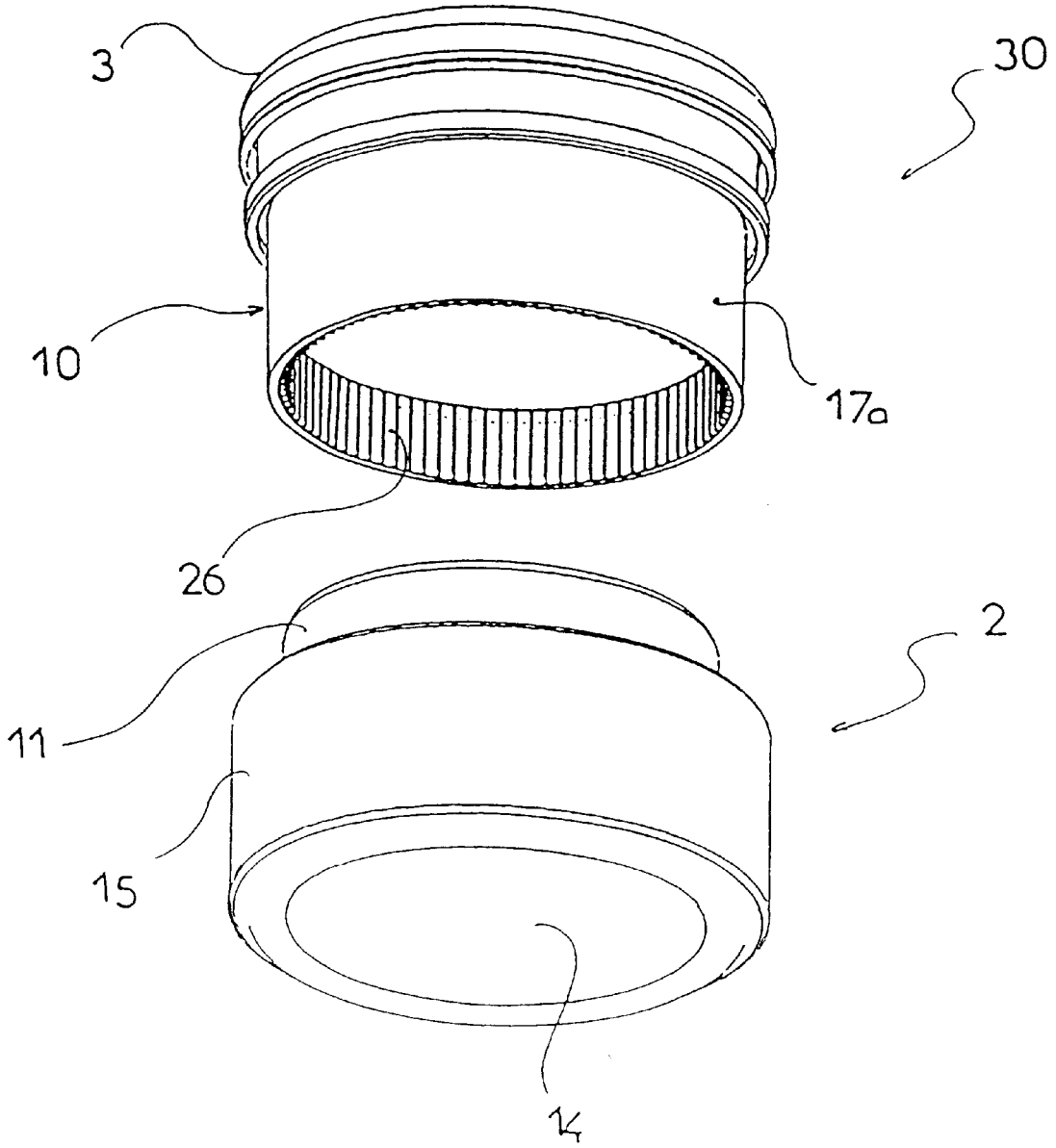
Figure 9:
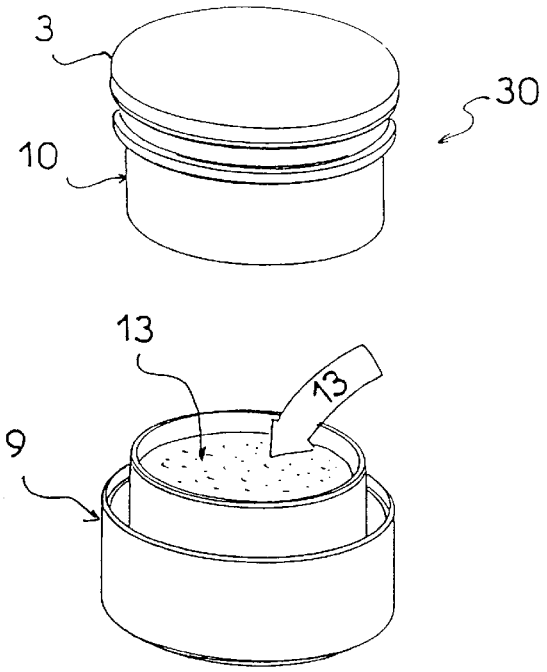
Figure 10:
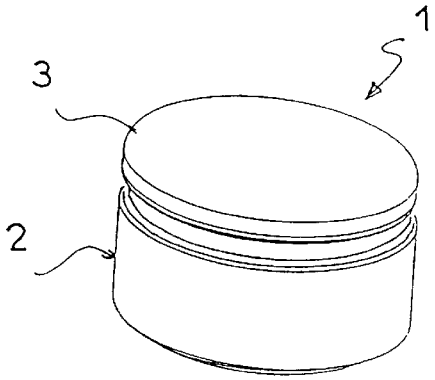
Figure 11:
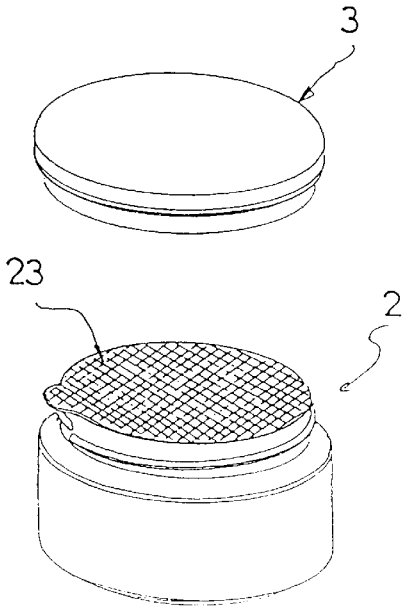
Figure 12:
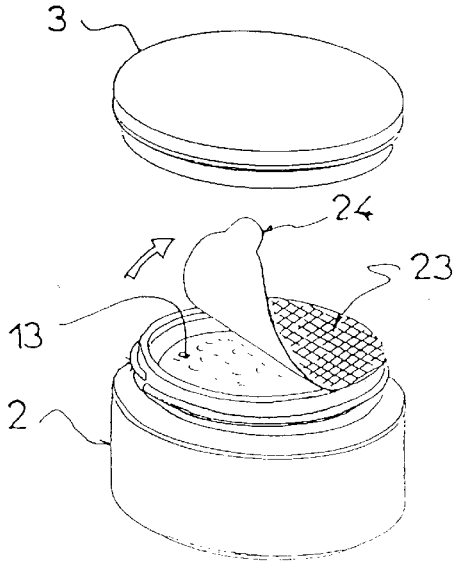

Furthermore, due to the cover (23) positioned on the intermediary part (10) before the mounting of the latter, the container can be submitted to the cosmetic laboratory in the position illustrated in FIGS. 7 and 8, i.e., the container body (9) itself and an upper assembly (30) constituted by the intermediary part (10) with its cover (23) on which the cap (3) with its gasket (7) is screwed. The laboratory will only have to fill the housing (12) of the container body (9) with cream (13), FIG. 9, then to position the upper assembly (30) by force fitting the latter on the container body (9), FIG. 10, until the latching means (27, 28) snap in. The container can then be opened at the convenience of the user who only has to remove the cap (3), as in FIG. 11, to reach the cream (13) by removing the cover (23), as illustrated in FIG. 12.

Figure 13:
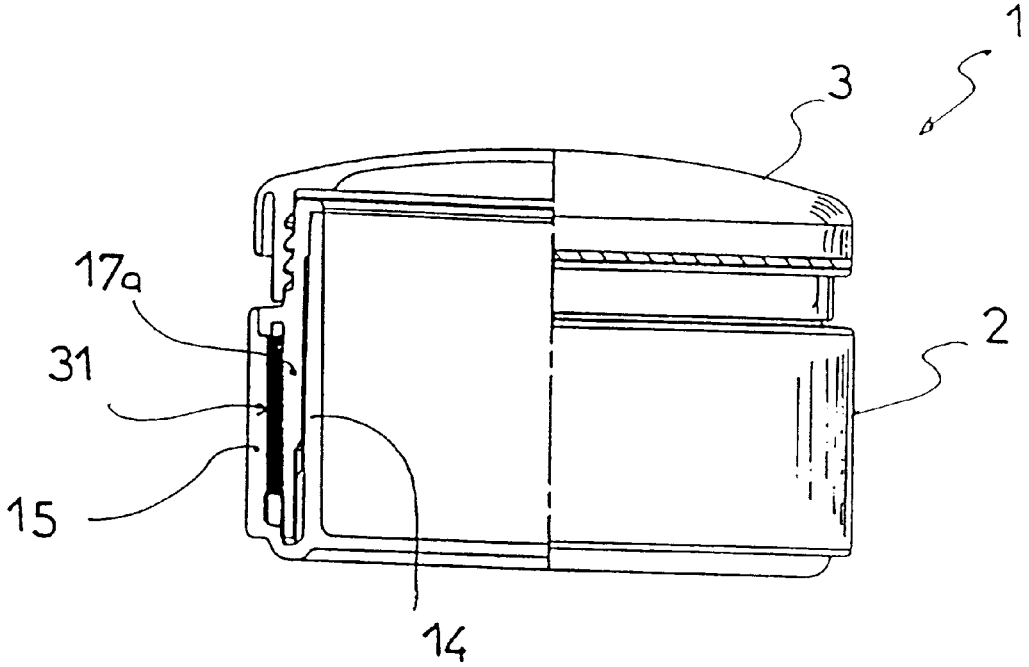
Figure 14:
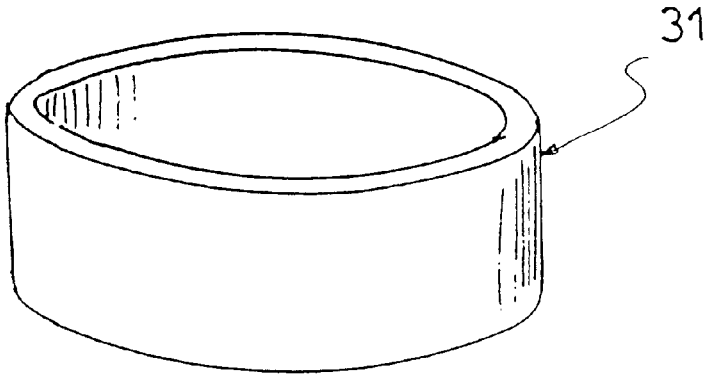

In an alternative embodiment, such as illustrated in FIGS. 13 and 14, a complementary part can be positioned to weigh down the container. This part can be constituted by a weight (31) having the shape of a cylindrical ring made of a higher density material than that of which the other parts are made. This ring can thus be made of high density resin or of loaded resin whose density can be of 2.5, for example. It is housed in the peripheral space (16) of the jar, as is shown more clearly in FIG. 13.

Figure 15:
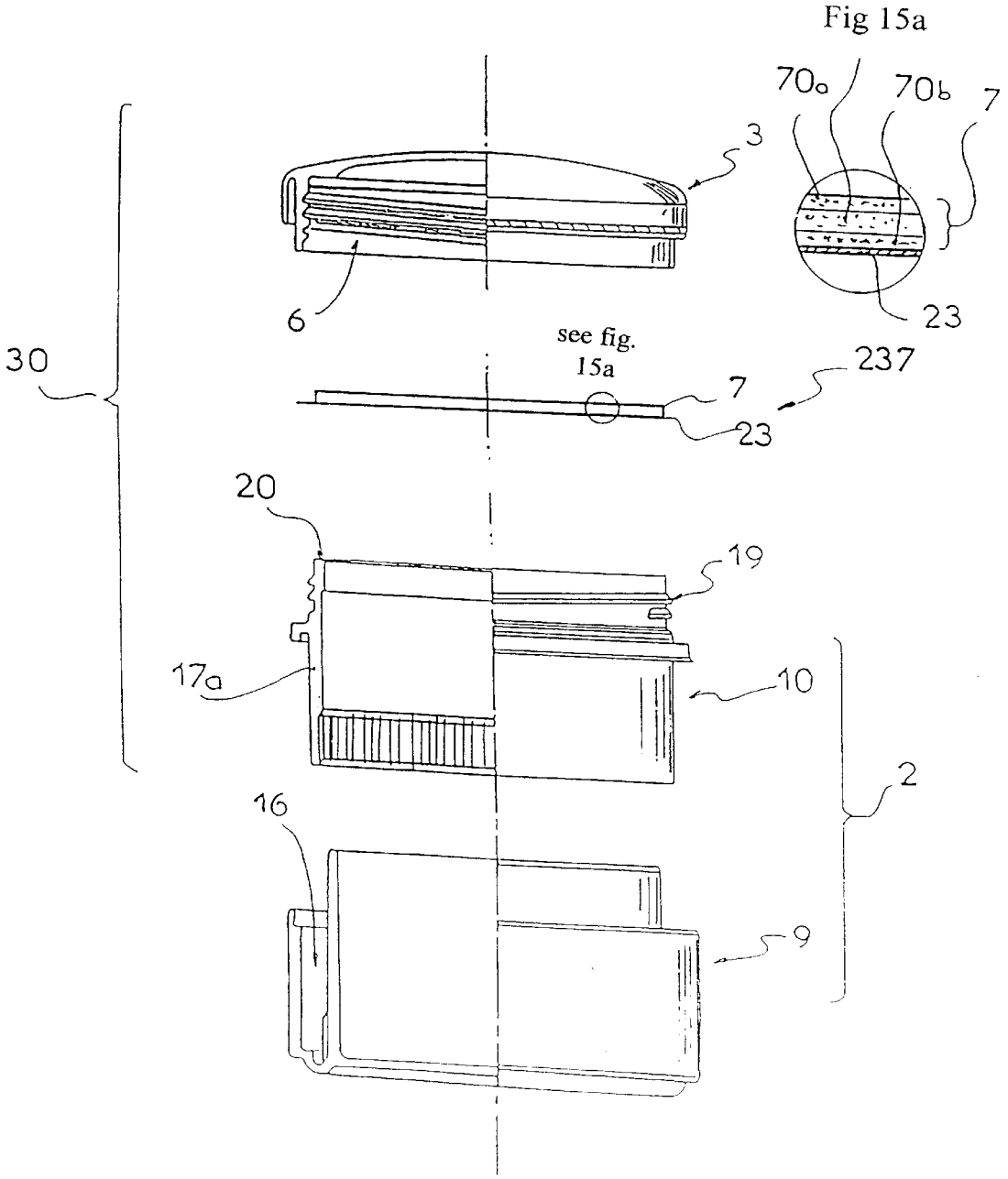
FIGS. 15 and 16 illustrate a variation of the invention regarding the positioning the cover.
Figure 16:
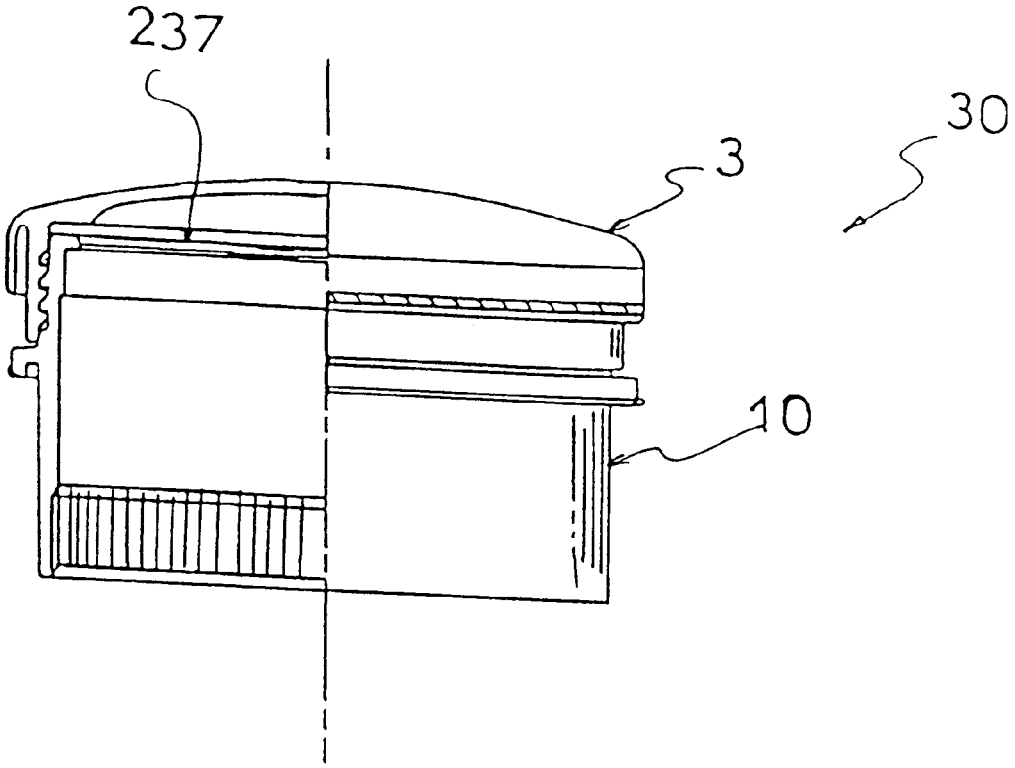

FIGS. 15 and 16 illustrate a variation according to which, in the process of manufacturing the container, a covered gasket (237) is used which includes the sealing gasket (7)

and the cover (23), the two elements being initially affixed. The covered gasket (237) is inserted between the cap (3) and the intermediary part (10), as illustrated in FIG. 16, the upper assembly (30) then being placed in an induction furnace causing the separation of the gasket (7) from the cover (23), on the one hand, and the welding of the cover on the edge (20) of the intermediary part (10), on the other hand. The gasket (7) of the covered gasket assembly is advantageously a foam assembly (71) sandwiched between two layers (70*a,* 70*b*) of polyethylene.

Figure 17:
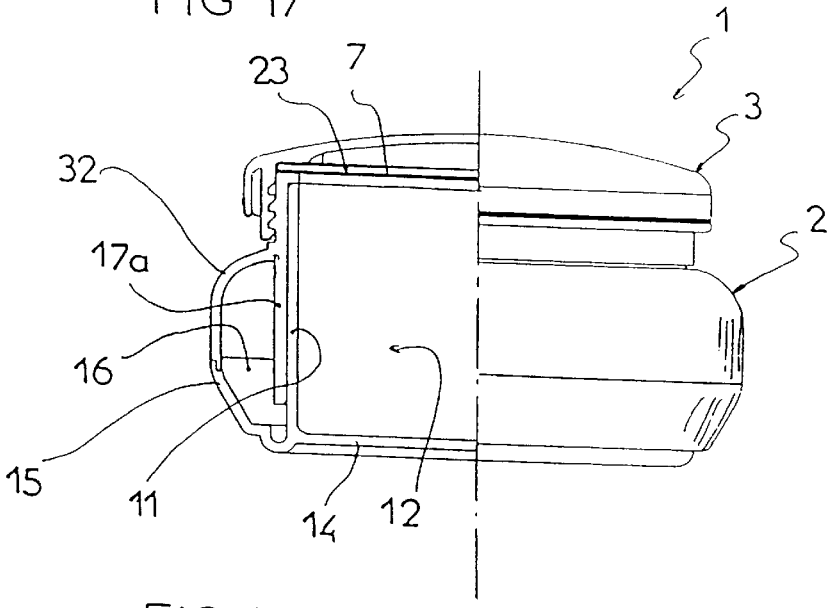
FIGS. 17, 18, and 19 show another embodiment according to which the intermediary part partially forms the external wall of the pot.
Figure 18:
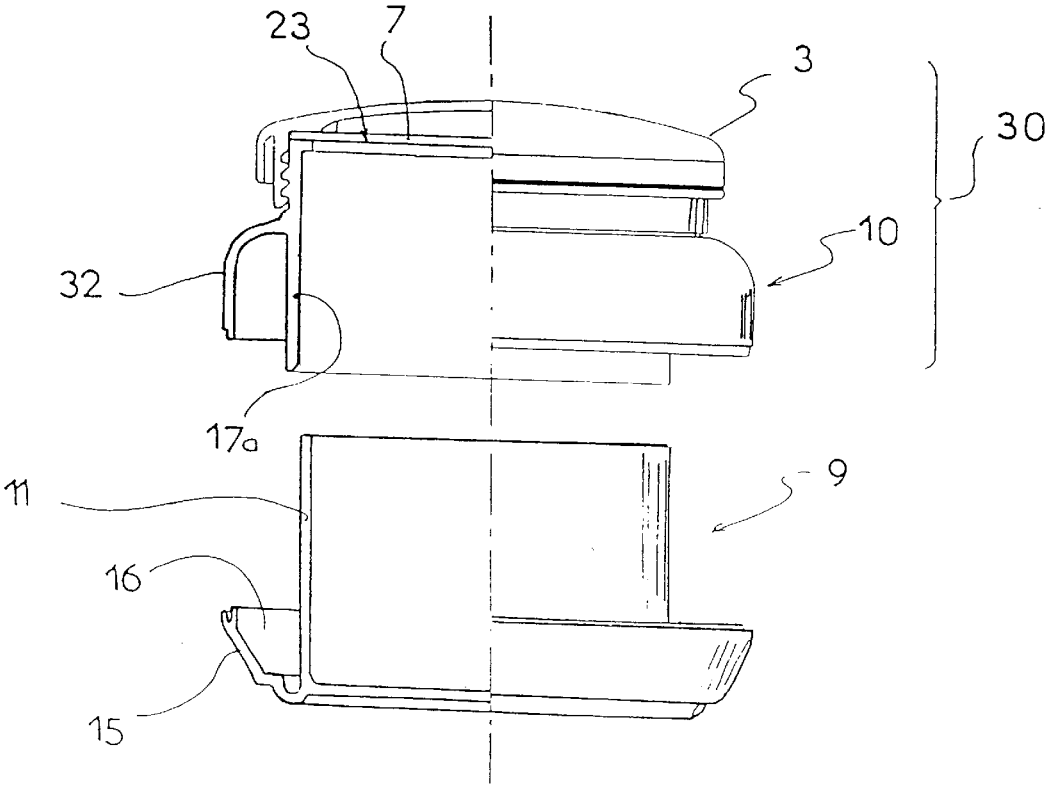
Figure 19:
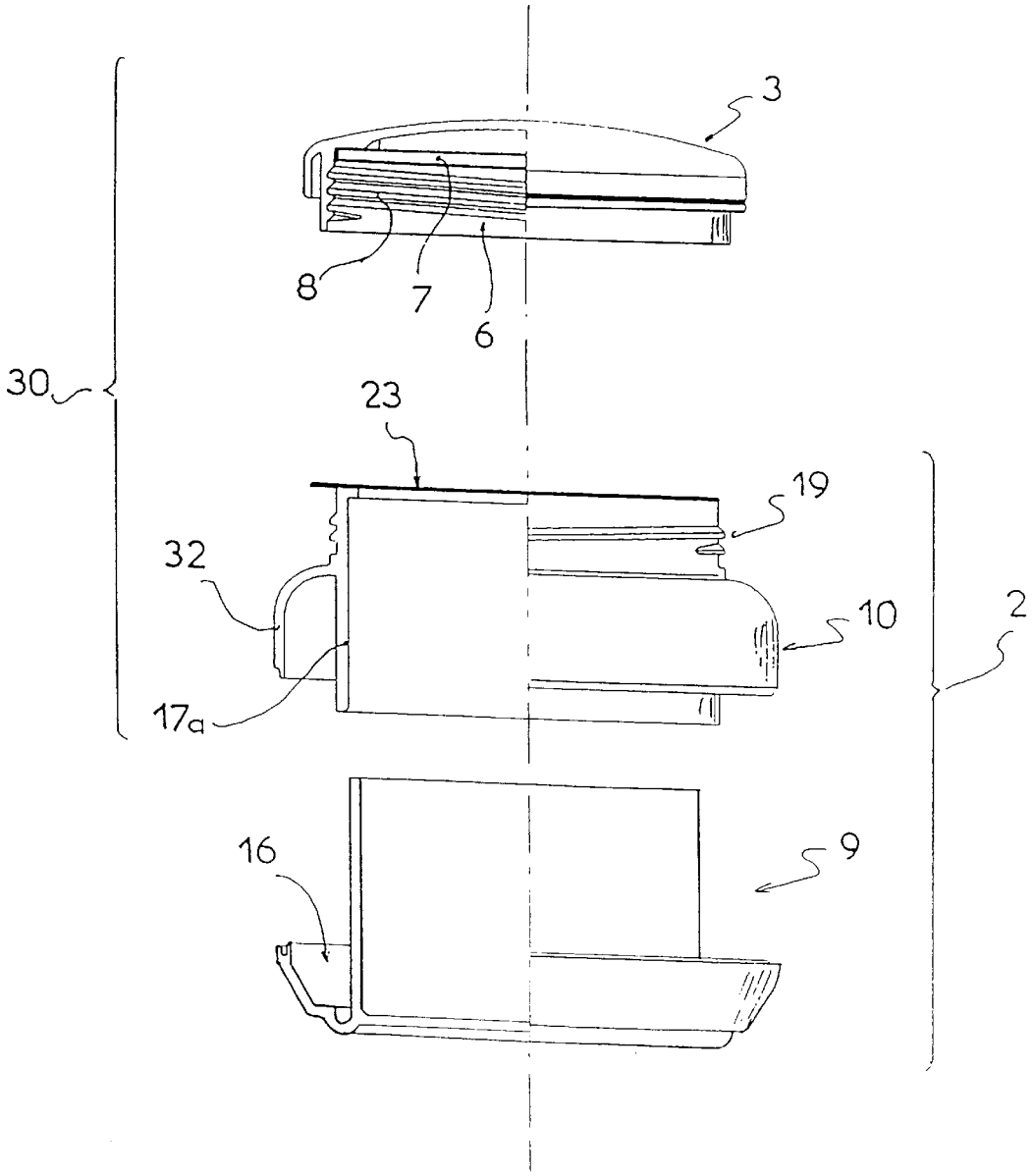

FIGS. 17, 18, and 19 illustrate another embodiment according to which the intermediary part (10) includes a complementary external peripheral wall (32) adapted to cooperate with and extend the second peripheral wall (15) of the jar. It is noted in this embodiment that the invention has a large number of possibilities with respect to the presentation of the container which can thus assume any forms, presentations and sizes.

Figure 20:
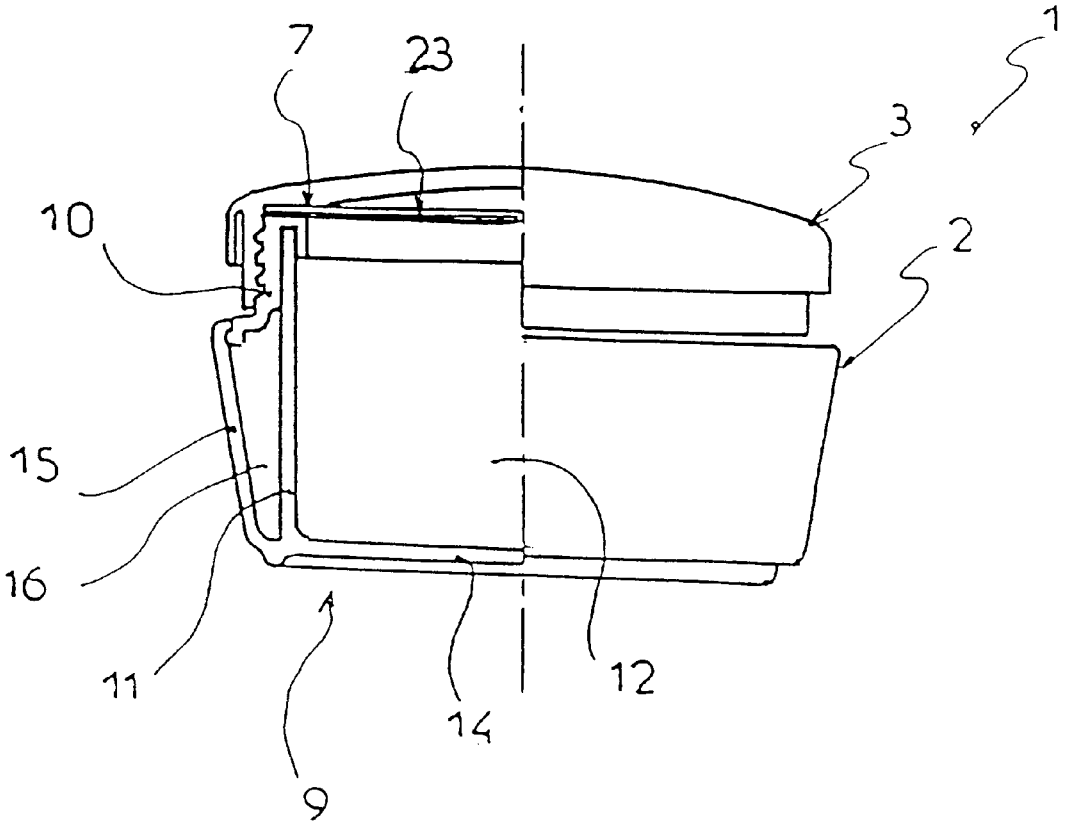
FIG. 20 is a lateral view with a half-section of another embodiment.

In the description that has been made, it is noted that the external wall of the jar (2) can be totally constituted by a peripheral wall (15) of the container body (9), and more particularly its second peripheral wall (15), as in the embodiment of FIGS. 1, 16 and 20, or partially constituted by this peripheral wall (15) and partially by a peripheral wall affixed to the intermediary part (10), such as illustrated in FIGS. 17, 18 and 19.

It is understood that one would not depart from the scope of the invention if the cover (23) was made of a plastic material, for example, polyethylene, polypropylene, or polyvinyl chloride, or the like, even an association of these materials in a multi-layer cover.

Of course, the invention is not limited to the embodiments described and shown by way of examples, but it also includes all the technical equivalents as well as their combinations.

We claim:

1. A container comprising:

a jar closed by a cap;

said jar comprising:

a container body, said container body having a bottom wall, an inner peripheral wall extending upwardly from said bottom wall and an outer peripheral wall extending upwardly laterally spaced from said inner peripheral wall, said outer peripheral wall at least partially forming an external wall of said jar, said bottom wall and said inner peripheral wall forming a housing for receiving a content of the container. said bottom wall, said inner peripheral wall, and said outer peripheral wall of said container body being formed as a unitary part;

an intermediary part affixed to said inner peripheral wall of said container body;

a removable cover positioned on said intermediary part; and said cap being secured to said intermediary part.

2. A container according to claim 1, wherein:

said outer peripheral wall of said container body totally constitutes said external wall of said jar.

3. A container according to claim 1, wherein:

said intermediary part includes an intermediary peripheral wall; and said external wall of said jar is partially constituted by said outer peripheral wall of said container body and partially constituted by said intermediary peripheral wall of said intermediary part.

4. A container according to claim 1, wherein:

said inner peripheral wall and said outer peripheral wall of said container body are separated by a peripheral space.

5. A container according to claim 1, wherein:

said outer peripheral wall is connected to said bottom wall, said bottom wall forming a base of said jar.

6. A container according to claim 1, wherein:

said housing is open upwardly, constituted by an upper edge of said inner peripheral wall; and said housing is closed downwardly, by said bottom wall.

7. A container according to claim 1, wherein:

said intermediary part is ring-shaped and comprises a generally cylindrical intermediary peripheral wall forming a central housing, said central housing having an external threaded upper portion, said upper portion having an upper edge;

said cap includes an internal threaded portion cooperating with said external threaded upper portion of said central housing; and said removable cover is positioned on said upper edge of said upper portion of said central housing.

8. A container according to claim 7, wherein:

said intermediary peripheral wall is extended downwardly by at least one wall extension.

9. A container according to claim 8, wherein:

said intermediary part is connected to said inner peripheral wall of said container body by a latching arrangement ensuring rotational and translational blocking of said intermediary part with respect to said container body.

10. A container according to claim 1, wherein:

said container body is formed as an injected plastic part.

11. A container comprising:

a container body and an upper assembly;

said container body comprising:

a bottom wall, an inner peripheral wall extending upwardly from said bottom wall and an outer peripheral wall extending upwardly laterally spaced from said inner peripheral wall, said outer peripheral wall at least partially forming an external wall of the container, said bottom wall and said inner peripheral wall forming a housing for receiving a content of the container, said bottom wall, said inner peripheral wall, and said container body being formed as a unitary part;

said upper assembly comprising:

an intermediary part affixed to said inner peripheral wall of said container body;

a removable cover positioned on said intermediary part; and a cap secured to said intermediary part to close the container.

12. A container according to claim 11, wherein:

said outer peripheral wall of said container body totally constitutes said external wall of the container.

13. A container according to claim 11, wherein:

said intermediary part includes an intermediary peripheral wall; and said external wall of the container is partially constituted by said outer peripheral wall of said container body and partially constituted by said intermediary peripheral wall of said intermediary part.

14. . A container according to claim 11, wherein:

said inner peripheral wall and said outer peripheral wall of said container body are separated by a peripheral space.

15. A container according to claim 11, wherein:

said outer peripheral wall is connected to said bottom wall, said bottom wall forming a base of the container.

16. A container according to claim 11, wherein:

said housing is open upwardly, constituted by an upper edge of said inner peripheral wall; and said housing is closed downwardly, by said bottom wall.

17. A container according to claim wherein:

said intermediary part is ring-shaped and comprises a generally cylindrical intermediary peripheral wall forming a central housing, said central housing having an external threaded upper portion, said upper portion having an upper edge;

said cap includes an internal threaded portion cooperating with said external threaded upper portion of said central housing; and said removable cover is positioned on said upper edge of said upper portion of said central housing.

18. A container according to claim 17, wherein:

said intermediary peripheral wall is extended downwardly by at least one wall extension.

19. A container according to claim 18, wherein:

said intermediary part is connected to said inner peripheral wall of said container body by a latching arrangement ensuring rotational and translational blocking of said intermediary part with respect to said container body.

20. A container according to claim 11, wherein:

said container body is formed as an injected plastic part.

21. A container comprising:

a container body including a bottom wall and an inner peripheral wall extending upwardly from said bottom wall, said bottom wall and said inner peripheral wall constituting an open-ended housing for contents to be placed in the container, said container body further including an outer peripheral wall extending upwardly and being laterally spaced from said inner peripheral wall, said outer peripheral wall at least partially forming an external wall of the container;

an intermediary part releasably affixed to said container body, said intermediary part having an upper opening and a lower opening, said intermediary part including an intermediary peripheral wall laterally surrounding and engaging said inner peripheral wall of said container body, said intermediary peripheral wall having an upper edge for defining said upper opening;

a releasable sealing cover secured to upper edge of said intermediary peripheral wall; and a cap releasably secured to said intermediary peripheral wall and positioned over said sealing cover.

* * * * *